US005425587A

United States Patent [19]

Takiguchi

[11] Patent Number: 5,425,587

[45] Date of Patent: Jun. 20, 1995

[54] PRINTER WITH END OF PRINT DATA RIBBON CONTROL

[75] Inventor: Kiyotsugu Takiguchi, Nagoya, Japan

[73] Assignee: Brother Kogyo Kabushiki Kaisha, Nagoya, Japan

[21] Appl. No.: 234,003

[22] Filed: Apr. 28, 1994

[30] Foreign Application Priority Data

May 8, 1993 [JP] Japan ..... 5-131461

[51] Int. Cl.[6] ..... B41J 33/36

[52] U.S. Cl. ..... 400/232; 400/225

[58] Field of Search ..... 400/225, 231, 232, 248

[56] References Cited

U.S. PATENT DOCUMENTS 4,709,242 11/1987 Uchikata et al. ..... 400/231

5,266,971 11/1993 Yoshida ..... 400/232

*Primary Examiner*—David A. Wiecking

*Assistant Examiner*—Steven S. Kelley

*Attorney, Agent, or Firm*—Oliff & Berridge

[57] ABSTRACT

A printer for reducing the consumption of a ribbon at a printing completion section. A ribbon feeder feeds an ink ribbon so as to carry out printing during a period in which heat transfer is being effected on recording paper. Further, the ribbon is continuously fed to a blank area or portion existing in the printing to determine the printing. When a final portion detector detects a final area or portion to be printed during the continuation of feeding of the ribbon toward the blank portion or during a period in which the feeding of the ribbon to the blank portion is stopped to wait for recommencement of the printing, a difference calculator calculates a difference between a feed length of a ribbon required to determine the printing and a length of a ribbon fed toward a blank portion calculated by a blank feed length calculator. Further, the ribbon feeder continues to feed the ribbon by the calculated difference, to thereby fix printing characters subjected to the heat transfer onto the recording paper.

22 Claims, 11 Drawing Sheets

10
TIP SENSOR
35
RAM
36
ROM
38
OPERATION PANEL
40
S/P CONVERTING CIRCUIT
42
CCD
44
P/S CONVERTING CIRCUIT
46
CPU
16
MODEM
14
NCU
12
JAM SENSOR
18
TEMPERATURE MEASURING DEVICE
20
STROBE GENERATING CIRCUIT
24
THERMAL HEAD
22
P/S CONVERTING CIRCUIT
26
MOTOR DRIVER
30
RECORDING-PAPER FEED MOTOR
28
MOTOR DRIVER
32
RIBBON SEPARATION MOTOR
31
MOTOR DRIVER
34
RIBBON FEED MOTOR
33

START
S1
LAST LINE ON PAGE ?
YES
NO
S12
SEPARATING OPERATION
S13
PAPER DISCHARGE OPERATION
S2
WHITE LINE?
YES
NO
INCREASE WHITE COUNTER
S9
S3
C > A ?
NO
YES
S10
C ≧ A ?
YES
NO
S4
FEED RECORDING PAPER AND RIBBON BY C-A
S8
C = 0 ?
NO
YES
S5
C ←0
S6
FEED RECORDING PAPER AND RIBBON BY ONE LINE
S11
SET CPU TO RECORDING STOP STATE
S7
OUTPUT STROBE
RETURN

START
S1'
LAST DATA ON LINE?
YES
NO
S12'
SEPARATING OPERATION
S13'
CARRIAGE RETURN OPERATION
S2'
WHITE DATA?
YES
NO
INCREASE WHITE COUNTER
S9'
S3'
C' > A' ?
NO
YES
S10'
C' ≧ A' ?
YES
NO
S4'
FEED CARRIAGE AND RIBBON BY C'-A'
S8'
C' = 0 ?
NO
YES
S5'
C' ← 0
S6'
FEED CARRIAGE AND RIBBON BY ONE COLUMN
S11'
SET CPU TO RECORDING STOP STATE
S7'
OUTPUT STROBE
RETURN

PRINTER WITH END OF PRINT DATA RIBBON CONTROL

BACKGROUND OF THE INVENTION

1. Field of the Invention

The invention relates to a heat-transfer type printer for winding a ribbon while printing is being performed and, more particularly, to a printer capable of reducing the consumption of a ribbon at a printing completion section.

2. Description of the Related Art

A conventional line-print type printer for winding or taking up a ribbon while a printing process is being executed will be described below with reference to FIG. 7. The printer causes a platen 53 to feed recording paper 51 upon printing and rotates a ribbon roll 57 so as to convey a ribbon 55 in synchronism with a feed speed of the recording paper 51. Further, the printer heats a heating element of a thermal head 22 for carrying out the printing in the form of a line so as to dissolve heat-soluble ink on the ribbon 55, thereby transferring it onto the recording paper 51. The printer feeds the ribbon 55 subjected to the heat transfer by a distance X corresponding to a time interval determined by characteristics of the heat-soluble ink in a state in which the thermal head 22 remains in a pressed condition (i.e., in a state in which the recording paper 51 and the ribbon 55 are brought into contact with each other not so as to be separated from each other), thereby fixing printing characters onto the recording paper 51. That is, it is necessary to use up or consume the ribbon 55 by the distance X without releasing the thermal head 22 after the printing has been carried out by the thermal head 22. The consumption of the ribbon 55 by the distance X is inevitable to improve the quality of the printing.

A so-called white-line skip operation executed by a printer such as used in a facsimile apparatus or the like will next be described with reference to FIGS. 8(A) and 8(B).

In the facsimile apparatus, even if a null or blank area or portion is formed on the recording paper 51 from a line 51A when the printing is being performed in line form as shown in FIG. 8(A), the recording paper 51 and a ribbon 55 are continuously fed in directions indicated by arrows Y1 and Y2, respectively. When the length of the blank portion existing under printing reaches a predetermined length A, the feeding of the recording paper 51 and the ribbon 55 is stopped so as to wait for the following printing. That is, the following printing is placed in a waiting state in a condition in which the ribbon 55 has been consumed by the length A. FIG. 8(B) shows the manner in which the recording paper 51 shown in FIG. 8(A) is viewed in a direction indicated by an arrow Y3. In FIG. 8(B), the printing is made to a shadowed area or portion above the line 51A, whereas the printing is not made to an area or portion below the line 51A due to the white line skip.

Further, a process effected in the case where the following print data is not input during standby in the above condition and a page end has been detected, will be described with reference to FIGS. 9(A), 9(B) and 9(C).

In the conventional facsimile apparatus as described above, when all the white lines free from the printing are detected, a white line skip is started so that each of a recording paper 51 and a ribbon 55 is fed by the predetermined length A and a process for starting the following printing is placed in a waiting state. When a page end is detected during its waiting state, the ribbon 55 is fed by the aforementioned distance X required to determine or fix the printing without any condition as shown in FIG. 9(A). Next, a thermal head 22 is released as shown in FIG. 9(B). Thereafter, the recording paper 51 is ejected or discharged as shown in FIG. 9(C). Therefore, when the printing is completed after the ribbon 55 has been fed by a distance corresponding to an A lines in accordance with the white line skip, the total length of A+X is consumed.

In order to reduce the consumption of an ink ribbon, U.S. Pat. No. 4,709,242 discloses a device in which a printhead is released from the platen every time blank (space) data is transferred to be printed. However, in such a device, the control for effecting up-and-down movement of the print head is very complicated. Likewise, there is a tendency to smudge or place ink on the recording medium when the printhead is returned to contact the ink ribbon next to the recording medium.

SUMMARY OF THE INVENTION

It is an object of the invention to provide a printer capable of reducing the consumption of a ribbon at a printing completion section.

According to one aspect of the invention, for achieving the above object, there is thus provided a printer comprising ribbon feeding means for conveying a ribbon during a period in which heat transfer is effected on recording paper and for continuously feeding the recording paper and the ribbon to fix or determine printing by the ribbon after the printing has been completed and continuously conveying the same to a blank portion or area existing during the printing to wait for the commencement of the following printing, blank feed length calculating means for calculating the length of the ribbon fed to the blank area existing during the printing by the ribbon feeding means, difference calculating means for calculating a difference between a feed length of the ribbon required to fix the printing and the length of the ribbon fed to the blank area which has been calculated by the blank feed length calculating means, and final portion detecting means for detecting a final portion on a page to be printed.

When the final portion detecting means detects the final portion on the page to be printed during a period in which the ribbon feeding means continues to feed the ribbon toward the blank area existing during the printing or during a period in which it stops the feeding of the ribbon to the blank area and is waiting for the commencement of the following printing, the difference calculating means calculates the difference between the feed length of the ribbon required to fix the printing and the length of the ribbon fed to the blank area. Further, the ribbon feeding means continuously feeds the ribbon by the length corresponding to the calculated difference.

According to the printer of the invention, which has the above-described structure, the ribbon feeding means feeds the ribbon so as to carry out the printing during the period in which the heat transfer is being effected on the recording paper. Further, the ribbon is continuously fed to the blank area existing during the printing to determine the printing. When the final portion detecting means detects the final portion to be printed during the continuation of feeding of the ribbon toward the blank area or during the period in which the feeding of the ribbon to the blank area is being stopped and the commencement of the next printing is being placed in the waiting state, the difference calculating means calculates the difference between the feed length of the ribbon required to determine the printing and the length of the ribbon fed toward the blank area, which has been calculated by the blank feed length calculating means. Further, the ribbon feeding means continues to feed the ribbon by the calculated difference to thereby fix the printing characters subjected to the heat transfer onto the recording paper.

Thus, since the ribbon feeding means feeds the ribbon by the difference between the feed length of the ribbon required to determine the printing and the length of the ribbon already fed toward the blank area, the consumption of the ribbon can be reduced as compared with a case where a ribbon having a length required to newly fix or determine the printing is fed from the final portion to be printed, which has been detected by the final portion detecting means.

As is apparent from the above description, the printer of the present invention can bring about an advantageous effect that since a ribbon is fed by the minimum quantity required to fix or determine the printing in view of the quantity of a ribbon fed upon execution of a white line skip, the consumption of the ribbon can be reduced to a minimum.

BRIEF DESCRIPTION OF THE DRAWINGS

A preferred embodiment of the invention will be described in detail with reference to the following figures, wherein.

DETAILED DESCRIPTION OF THE PREFERRED EMBODIMENTS

Preferred embodiments of the invention will be hereinafter described in detail with reference to the accompanying drawings.

A first embodiment of a printer for a facsimile equipment or other equipment will be first described below with reference to FIG. 1 through FIG. 5.

Figure 1:
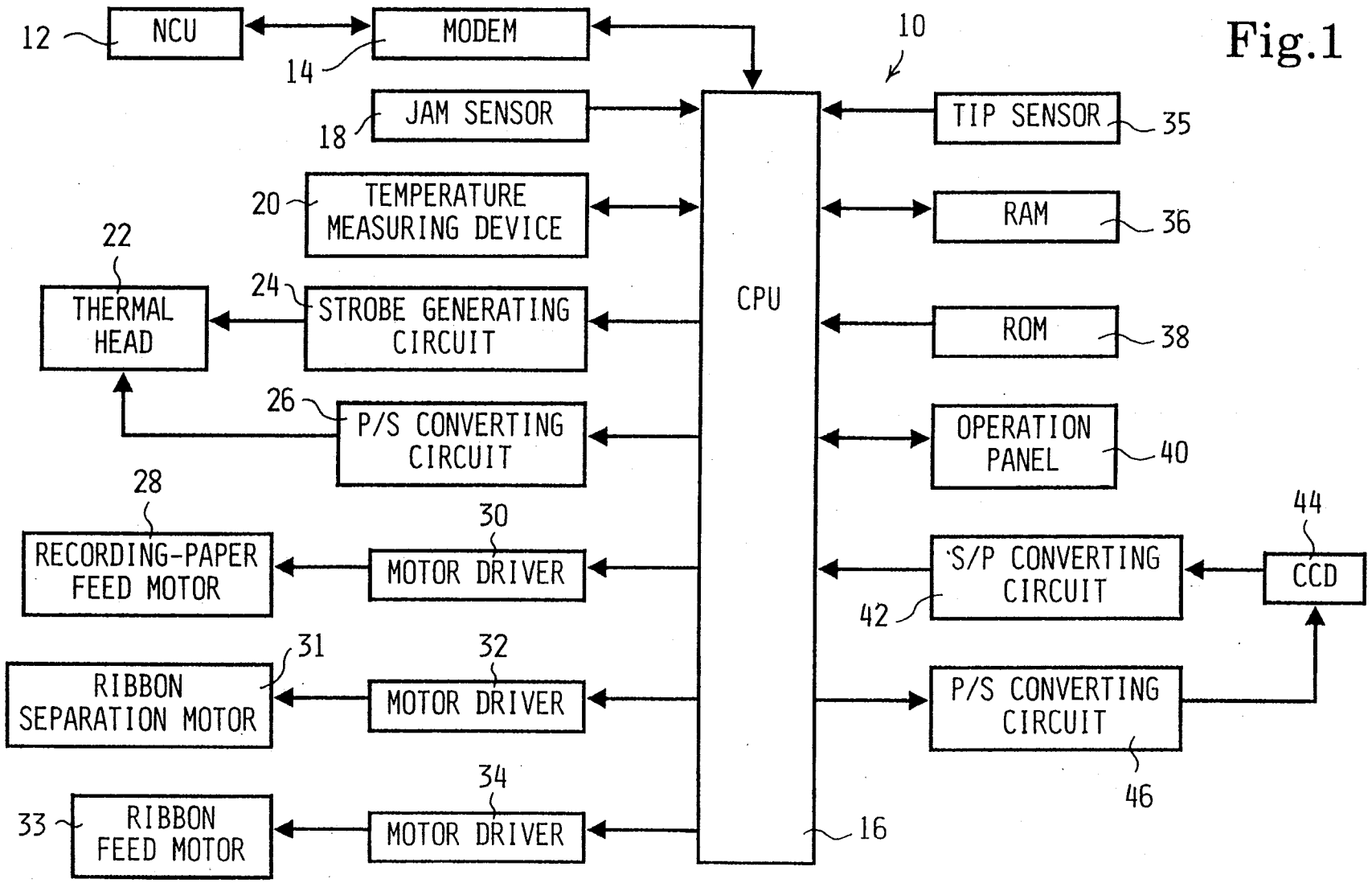
FIG. 1 is a block diagram showing a printer apparatus in a first embodiment according to the invention.
Figure 2:
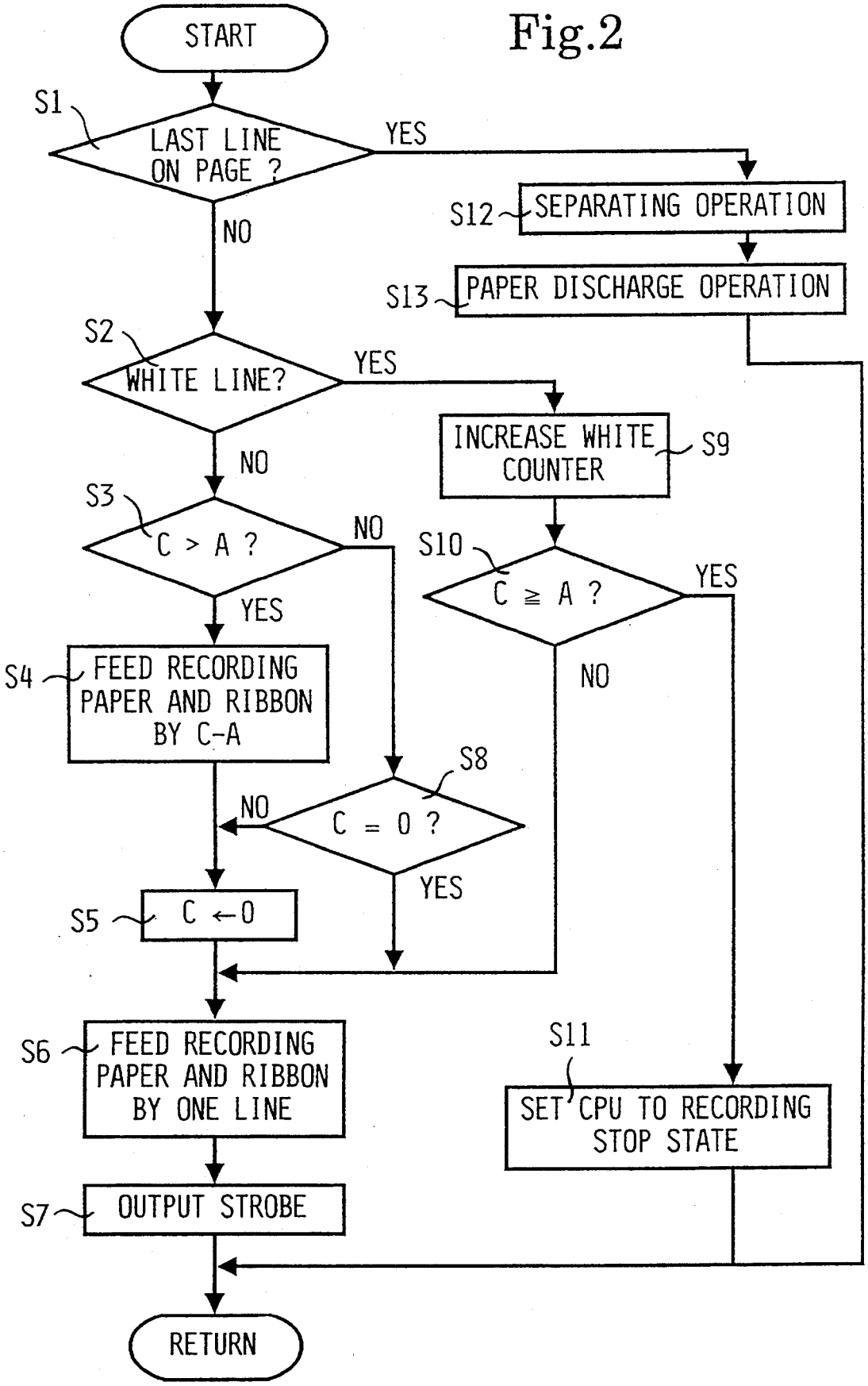
FIG. 2 is a flowchart of a printing operation of the printer apparatus shown in FIG. 1.
Figure 3:
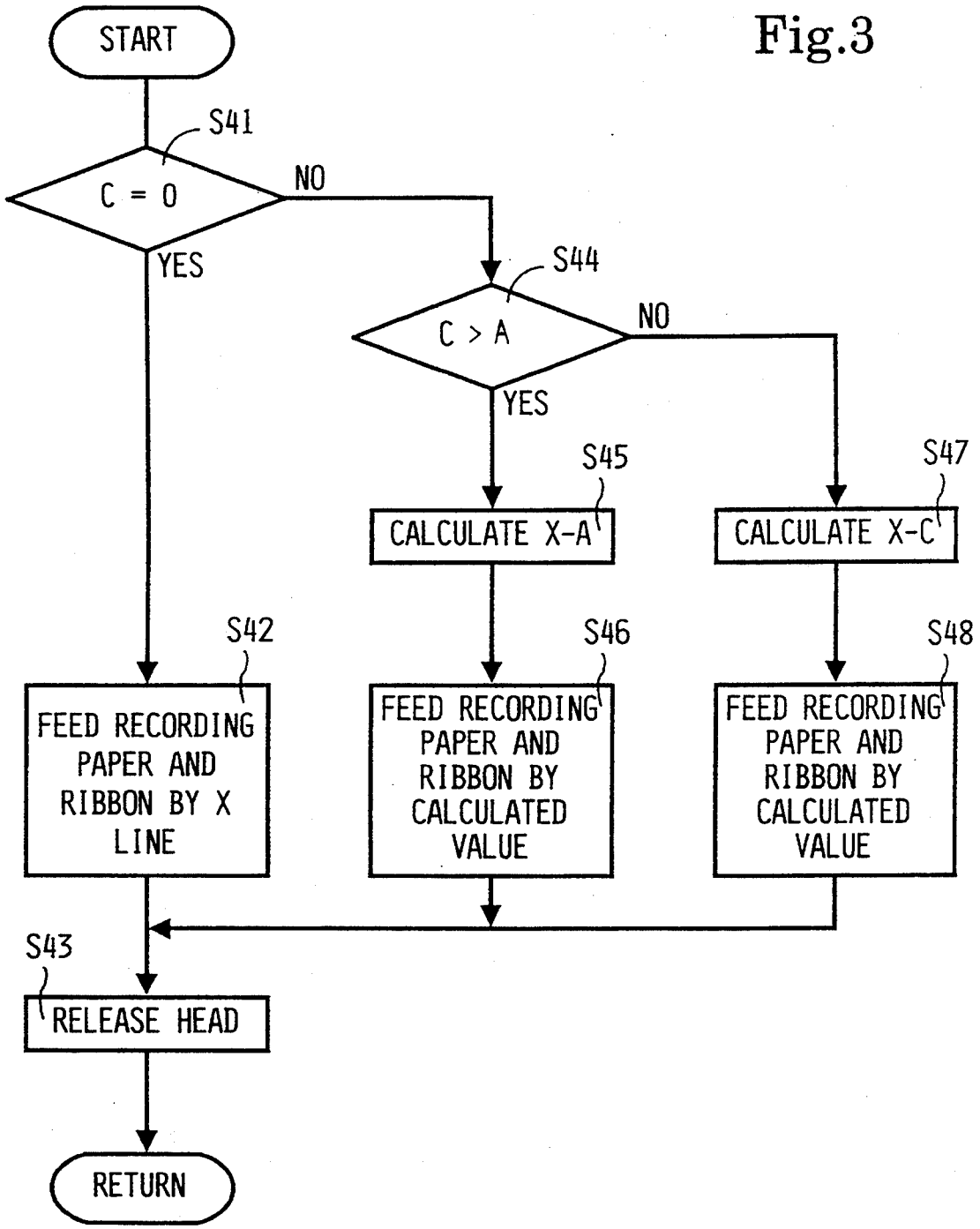
FIG. 3 is a flowchart for describing, in detail, the releasing or separating operation of the flowchart shown in FIG. 2.
Figure 4:
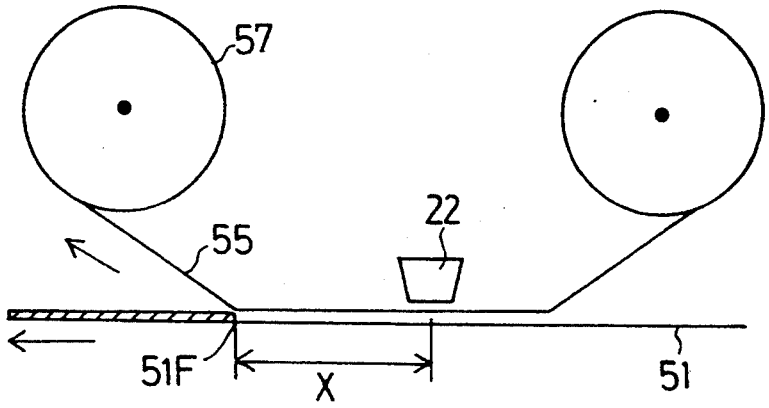
FIGS. 4(A), 4(B) and 4(C) are, respectively, schematic views for describing a ribbon feed operation of the printer apparatus shown in FIG. 1.
Figure 4:
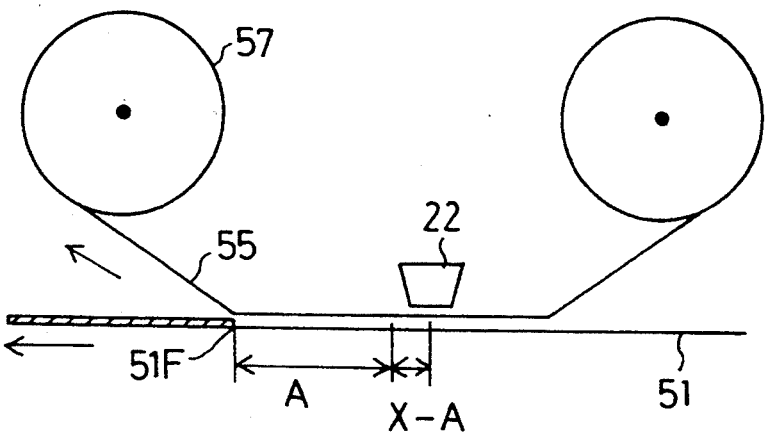
Figure 4:
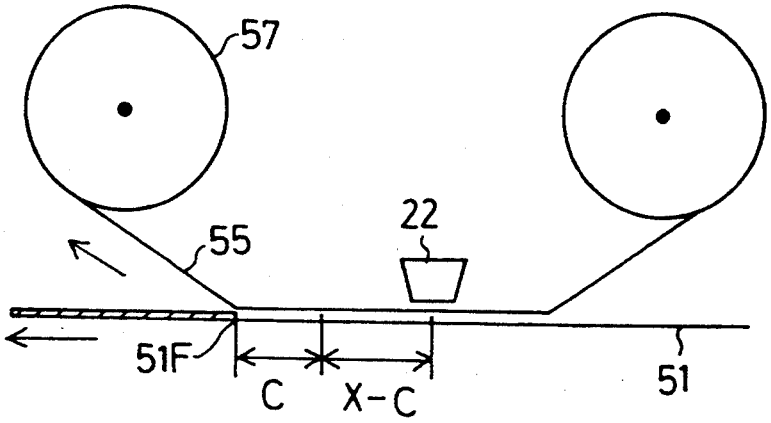

FIG. 1 is a block diagram showing the structure of a facsimile apparatus 10 in which the printer of the first embodiment is mounted. The invention will be described in the context of a facsimile apparatus. However, other contexts in which savings of ink ribbons can be obtained will be obvious to those skilled in the art upon review of this disclosure.

The facsimile apparatus 10 comprises an NCU (Network Control Unit) 12 for providing an electrical connection between a public line and the facsimile apparatus 10, a modem 14 for demodulating an analog signal sent via a telephone line to a digital signal and modulating a digital signal on the facsimile apparatus 10 side to an analog signal to send via the telephone line, and a CPU 16 for effecting communications and printing control. Connected to the CPU 16 are a jam sensor 18 for detecting a paper jam in the facsimile apparatus 10, a thermal head 22 for printing data on recording paper 51, a strobe generating circuit 24 for supplying a strobe to the thermal head 22, a P/S converting circuit 26 for converting or transforming image information sent from the CPU 16 as a parallel signal into a serial signal and supplying the converted signal to the thermal head 22, a temperature measuring device 20 for measuring the temperature of the thermal head 22, a motor driver 30 for driving a recording-paper feed motor 28 used to convey the recording paper 51, a motor driver 32 for driving a ribbon separation motor 31 used to press a printing ribbon 55 and the recording paper 51 together and to separate or release the printing ribbon 55 from the recording paper 51, a motor driver 34 for driving a ribbon feed motor 33 used to rotate a ribbon roll 57 for feeding the ribbon 55, a tip sensor 35 for detecting a position of a tip portion of the conveyed recording paper 51, a RAM 36 which forms a white line counter C for storing therein the number of white lines to be described later, and for temporarily storing therein image information or the like sent from a facsimile apparatus on the other or calling party side, a ROM 38 for retaining control information or the like about the facsimile apparatus 10, an operation panel 40 provided with switches for operating the facsimile apparatus 10 and used to effect various displays using a LED, a CCD 44 used to obtain image information to be transmitted to the facsimile apparatus on the other party side, an S/P converting circuit 42 for converting image information indicative of a serial signal sent from the CCD 44 into a parallel signal and supplying the converted signal to the CPU 16, and a P/S converting circuit 46 for transforming a signal sent from the CPU 16 as a parallel signal into a serial signal and supplying the transformed signal to the CCD 44.

A printing process executed by the facsimile apparatus 10 in the embodiment so structured will be next described below. Prior to the description of the printing process, an original (image information) transmitted from the facsimile apparatus on the other party side will be first described with reference to FIG. 5. In an original 80, a portion or area to be printed first extends from a line 80C at the top of the original 80 to a line 80D, a blank portion or area extends from the line 80D to a line 80E, a portion or area to be printed extends again from the line 80E to a line 80F, and a blank portion or area extends from the line 80F to the end of the original 80.

Figure 5:
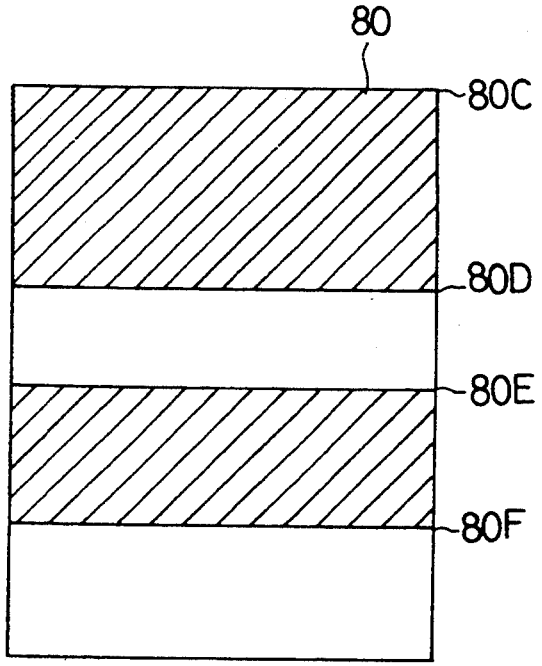
FIG. 5 is a view schematically showing the contents of image information sent from a calling party to be printed.

When image information (original 80) shown in FIG. 5, which has been sent from the facsimile apparatus on the other party side, is received by the NCU 12 in the facsimile apparatus 10 shown in FIG. 1, the image information is demodulated to a digital signal by the modem 14 so as to be supplied to the CPU 16. The CPU 16 decodes the image information which has been data-compressed and sent to produce data to be printed based on the decoded image information. Thereafter, the CPU 16 performs a printing process for each line based on the data to be printed. This printing process will be described with reference to a flowchart shown in FIG. 2.

The CPU 16 first determines, in Step S1, whether a printing line corresponds to the last line on a page. Since the line 80C in the original 80, which corresponds to a print start portion, is not the last line, the answer is "NO" in Step S1. Thus, the routine proceeds to Step S2. It is determined in Step S2 whether the corresponding line is a white line, i.e., a blank portion or area for printing. Since the line 80C is not a white line but a portion or area to be printed, in Step S2, the answer is "NO". Hence, the routine proceeds to Step S3. In Step S3, it is determined whether a value counted by the white line counter C storing the number of blank areas or white lines therein is greater than a stop value A used in performing a white line skip. The stop value A is a value previously determined. Since the printing has just started, the value of the white line counter C is 0 and lower than the stop value A. Thus, the answer is "NO" in Step S3 and the routine proceeds to Step S8. It is determined in Step S8 whether the value of the white line counter C is "0." Since the value of the white line counter C is "0" in Step S8, the answer is "YES" in Step S8, and hence, the routine shifts to Step S6. In Step S6, the CPU 16 sends a command or instruction to the motor driver 30 to drive the recording-paper feed motor 28, thereby feeding the recording paper 51 by one line. Further, the CPU 16 gives an instruction to the motor driver 34 to drive the ribbon feed motor 33 so as to rotate the ribbon roll 57, thereby feeding the ribbon 55 by one line. Next, the CPU 16 gives a print instruction to the strobe generating circuit 24 in Step S7. As a result, the strobe generating circuit 24 outputs a strobe to the thermal head 22 to thereby effect printing on the corresponding line. A printing process corresponding to one line is completed based on the series of operations referred to above and the routine returns to Step S1 so that a printing process for the next line is started.

The printing process executed for each line is repeated until the line 80D on the original 80, as shown in FIG. 5, is reached. A process about the blank area or portion is started with the line 80D. After completion of Step S1, the CPU 16 determines, in Step S2, whether the corresponding line 80D is a white line, i.e., a blank portion for printing. Since the line 80D is determined to be a white line, the answer is "YES" in Step S2, and the routine proceeds to Step S9. In Step S9, a value C of the white line counter, which counts the number of blank portions or lines, is increased by a value corresponding to one line. Next, the routine proceeds to Step S10, where it is determined whether the value C of the white line counter is greater than or equal to the value A for stopping a white line skip. Normally A is set to a value of 160 lines which equates to approximately one centimeter. Since the value C of the white line counter is smaller than the stop value A when the process about the blank portion has just started (i.e., the answer is "NO" in Step S10), the routine proceeds to the process in Step S6. In Step S6, the CPU 16 feeds the recording paper 51 and the ribbon 55 by one line. Next, the routine procedure proceeds to Step S7, where the CPU 16 gives a strobe output instruction to the strobe generating circuit 24 to print a null or blank line. As a result, a blank area or portion is formed on the recording paper 51. The process for the one line is executed based on the just described series of operations and the routine returns to Step S1 so that a process for the following line is started.

When the above process is repeated to execute a printing process for the blank area or portion and the process for a line corresponding to the stop value A for the white line skip is executed from the line 80D, the value C of the white line counter is made equal to the stop value A. Thus, the answer is "YES" in Step S10 and the routine proceeds to Step S11, where the CPU 16 is brought into a recording stop state. That is, the CPU 16 stops operating under the condition in which the recording paper 51 and the ribbon 55 have been fed by the A lines corresponding to the stop value. In this condition, the CPU 16 resumes the next printing operation or is placed in a waiting state until the last line on the page appears. At this time, the thermal head 22 is not released and the recording paper 51 is kept in a state of being in contact with the ribbon 55. Further, if data about the white line is continuously sent, the value C of the white line counter is increased in Step S9 under the recording stop state.

When data other than the data about the white line is sent, the answer is "NO" again in Step S2 and the routine proceeds to Step S3. In Step S3, the CPU 16 makes a decision as to whether the value C of the white line counter is greater than the stop value A at the time of execution of the white line skip. Since the value C of the white line counter is greater than the stop value A herein, the answer is "YES" in Step S3 and the routine proceeds to Step S4. In Step S4, a further increase in the line from the stop value A at which the feeding of the recording paper 51 and the ribbon 55 has been stopped, i.e., a value obtained by subtracting the stop value A from the value C of the white line counter is determined. Further, the recording paper 51 and the ribbon 55 are fed by a number of lines corresponding to the so-determined value. Thus, the recording paper 51 is fed to a position corresponding to the line 80E on the original 80 shown in FIG. 5. Next, the routine proceeds to Step S5, where the value C of the white line counter is reset to 0. Thus, the blank area or portion is ended.

On the other hand, if the answer is negative in Step S3, that is when data other than the data about the white line is sent before executing the process about the A lines corresponding to the stop value for the white line skip, the routine procedure proceeds to Step S8, where a line counter is "0." Thus, the blank area or portion is ended. Since, at this time, the value of the white line counter is not "0" in Step S8, the answer is "NO" in Step S8 and the routine shifts to Step S5, where the value C of the white line counter is reset or initialized. Next, the routine procedure proceeds to Step S6. In Step S6, the CPU 16 feeds each of the recording paper 51 and the ribbon 55 by one line. In Step S7, the CPU 16 then gives a command or instruction to the strobe generating circuit 24 to thereby carry out printing of the corresponding line. The processing of one line is executed based on the series of operations described above and the routine returns to the process in Step S1 so that a process for the following line is started.

When the process for the line 80F, on the original 80 shown in FIG. 5, is reached, the answer is "YES" in Step S2 again because the line 80F is a white line. Thus, the routine proceeds to Step S9. In Step S9, the value C of the white line counter is increased by a value corresponding to one line. The routine then proceeds to Step S10, where a decision is made as to whether the value C of the white line counter is greater than or equal to the stop value A. Since, at this time, the value C of the white line counter is smaller than the stop value A in Step S10 (i.e., the answer is "NO" in Step S10), the routine proceeds to Step S6 and the CPU 16 feeds each of the recording paper 51 and the ribbon 55 by one line. Next, the routine proceeds to Step S7, where the CPU 16 gives an output instruction to the strobe generating circuit 24 to print a null or blank line. As a result, a blank area or portion is formed on the recording paper 51. This process is repeated for each line.

A description will now be made of a case where the last line on the page has been detected during the process about each line subsequent to the above line 80F. When the last line is first detected, the answer is "YES" in Step S1 and hence the routine procedure proceeds to Step S12. At Step S12, a release or separating operation is started. The separating operation executed in Step S12 will be described with reference to the flowchart of FIG. 3 for describing the separating operation in detail and schematic views of FIGS. 4(A), 4(B) and 4(C) for describing the operation for feeding the recording paper 51 and the ribbon roll 57 upon the separating operation. It is first determined in Step S41 whether the value C of the white line counter is "0." When the value C of the white line counter is found to be "0" (when the answer is "YES" in Step S41), i.e., when neither the recording paper 51 or the ribbon 55 is fed from a position of a line 51F on the recording paper 51, that is, line 51F shown in FIG. 4(A) is beneath the thermal head 22, which corresponds to the line 80F on the original 80 shown in FIG. 5, the routine procedure proceeds to Step S42, where each of the recording paper 51 and the ribbon 55 is fed by a distance X corresponding to a length required to determine printing as illustrated in FIG. 4(A). Next, the routine proceeds to Step S43 where the thermal head 22 is released. Thereafter, the routine proceeds to Step S13 on the flowchart shown in FIG. 2, where the process for discharging or ejecting the recording paper 51 is executed.

On the other hand, if it is determined in Step 41 that the value C of the white line counter is not "0" (if the answer is "NO" in Step S41), i.e., if it is determined that each of the recording paper 51 and the ribbon 55 has been fed by several lines from the position of the line 51F as shown in FIGS. 4(B) and 4(C), the routine proceeds to Step S44. It is determined in Step S44 whether the value C of the white line counter is greater than the stop value A, i.e., it is determined whether the recording paper 51 and the ribbon 55 have been fed by the A lines corresponding to the stop value as described above with reference to the flowchart of FIG. 2 and the CPU 16 has been brought into a stop state. If the value C of the white line counter is greater than the stop value A, i.e., if it is determined that the CPU 16 has been stopped in a state in which the ribbon 55 has been fed by the A lines corresponding to the stop value (if the answer is "YES" in Step S44), the routine proceeds to Step S45. The stop value A is subtracted from a value X for determining the printing in Step S45. The routine then proceeds to Step S46, where each of the recording paper 51 and the ribbon 55 is further fed by a value of X−A from a state in which the ribbon 55 has been fed by the A lines starting from the line 51F of the recording paper 51 and stopped from moving as shown in FIG. 4(B) to thereby determine the printing. Thus, both the recording paper 51 and the ribbon 55 are fed by the sum of the A lines by which both the recording paper 51 and the ribbon 55 have been previously fed and the X−A lines, i.e., for a total of X lines. Further, the routine procedure proceeds to Step S43, where the thermal head 22 is released. Thereafter, the routine procedure is returned to Step S13 on the flowchart shown in FIG. 2, where the process for discharging or ejecting the recording paper 51 is executed.

If it is determined in Step S44 that the value C of the white line counter is smaller than the stop value A, i.e., if both of the recording paper 51 and the ribbon 55 are fed by C lines into a blank area or portion as shown in FIG. 4(C), but the A lines, at which the feeding of the ribbon 55 is stopped, have not been fed (i.e., if the answer is "NO" in Step S44), then the routine procedure proceeds to Step S47. In Step 47, the value C of the white line counter is subtracted from the value X for the determination of printing. Next, the routine proceeds to Step S48, where both the recording paper 51 and the ribbon 55 have been fed by the C lines starting from the line 51F of the recording paper 51 and are further fed by a calculated X−C line as shown in FIG. 4(C). Thus, both the recording paper 51 and the ribbon 55 are fed by the sum of the C lines, by which each of them has already been fed, and the X−C lines, i.e., for a total of X lines, to thereby determine the printing. Further, the routine procedure proceeds to Step S43, where the thermal head 22 is released. Thereafter, the routine returns to Step S13 so that the recording paper 51 is discharged.

Figure 9A:
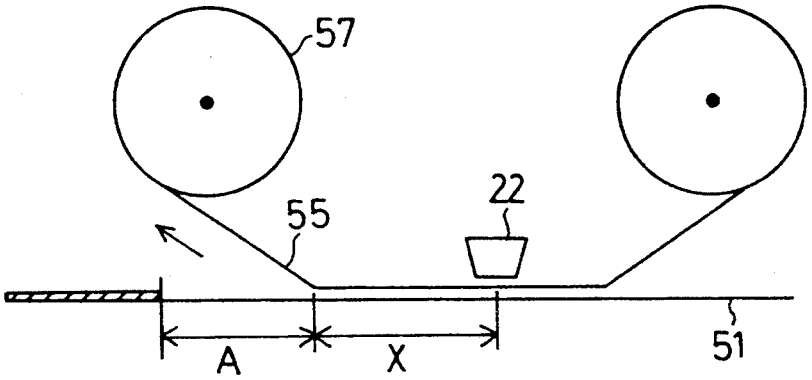
Fig.9(A) RELATED ART
FIGS. 9(A), 9(B) and 9(C) are respectively schematic views for describing a print on-completion operation performed by the printer shown in FIG. 7.
Figure 9B:
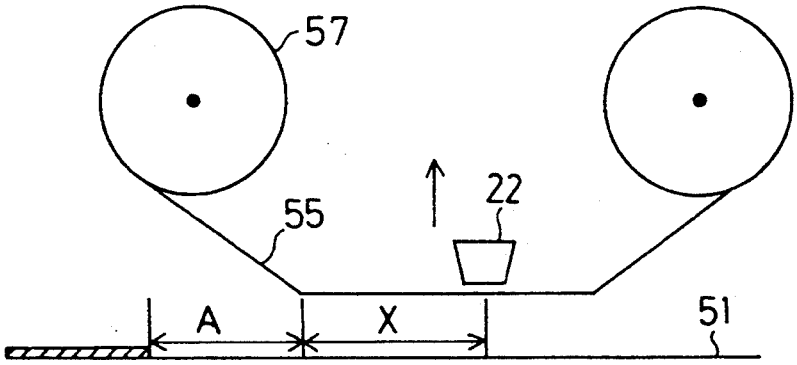
Fig.9(B) RELATED ART
Figure 9C:
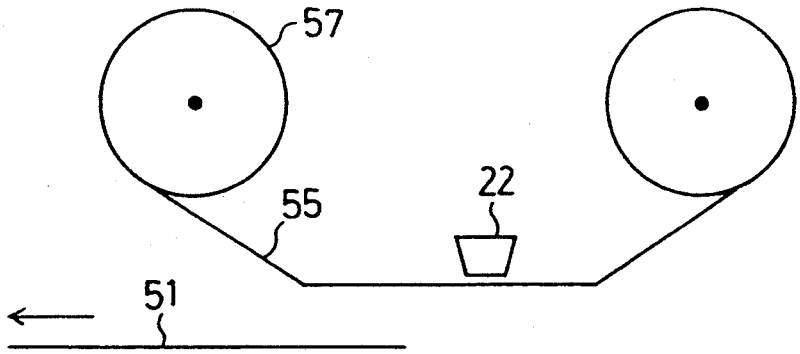
Fig.9(C) RELATED ART

In the present embodiment, when the printing has been completed, the ribbon 55 is fed based on the quantity of feeding of the ribbon 55 which has already been fed after the white line skip has been started in such a manner that the sum of feeding quantities is brought to the quantity of feeding X for determining the printing as shown in FIGS. 4(A), 4(B) and 4(C). Therefore, the ribbon 55 can be saved by a length corresponding to the A lines as compared with the aforementioned conventional printer in which the ribbon 55 has been fed by the X lines for determining the printing without any condition and the value A for stoppage of the white line skip, i.e., the A+X lines with reference to FIGS. 9(A), 9(B) and 9(C).

Figure 6:
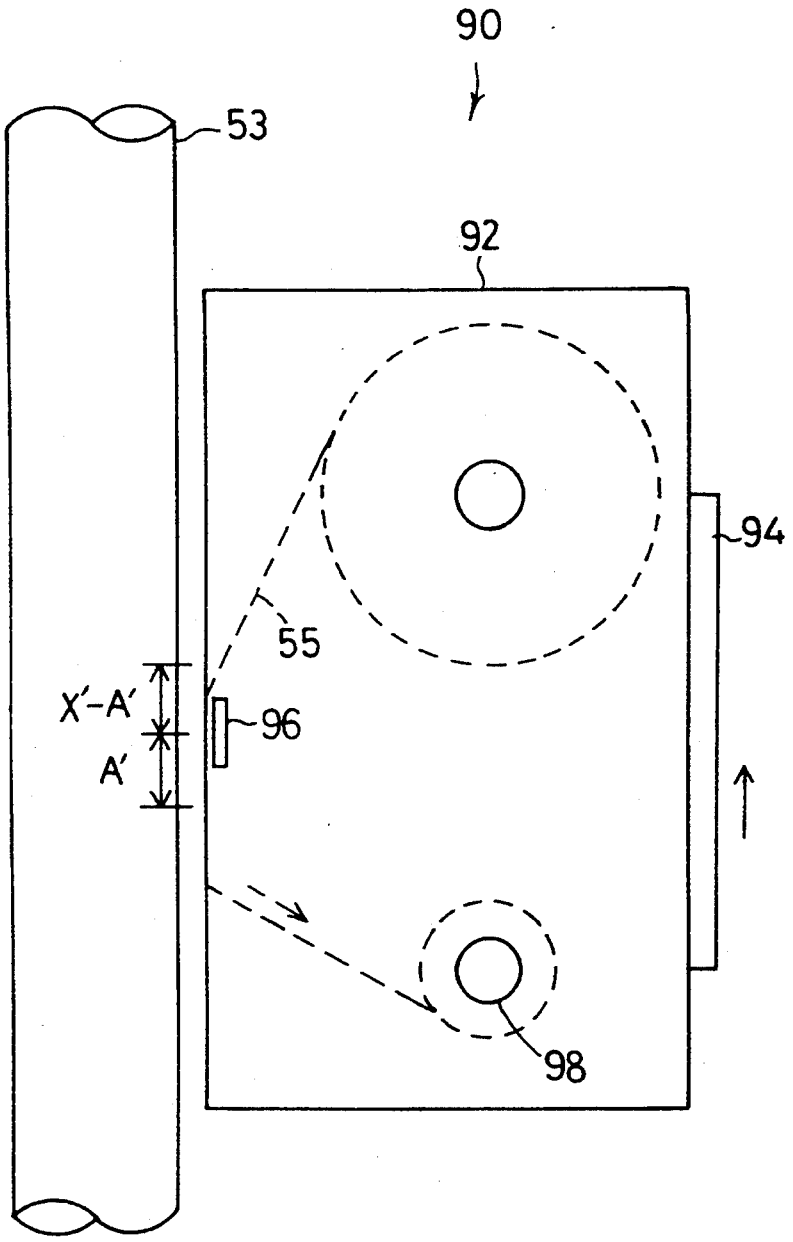
FIG. 6 is a schematic view for describing a ribbon feed operation carried out by a printer apparatus in a second embodiment.
Figure 7:
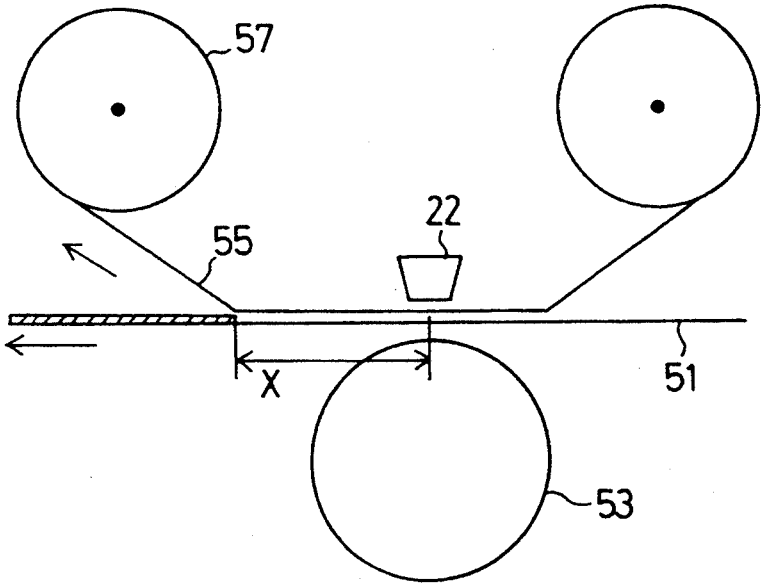
Fig.7 RELATED ART
FIG. 7 is a schematic view for explaining a ribbon feed operation for determining the printing of a printer according to a related art.
Figure 8A:
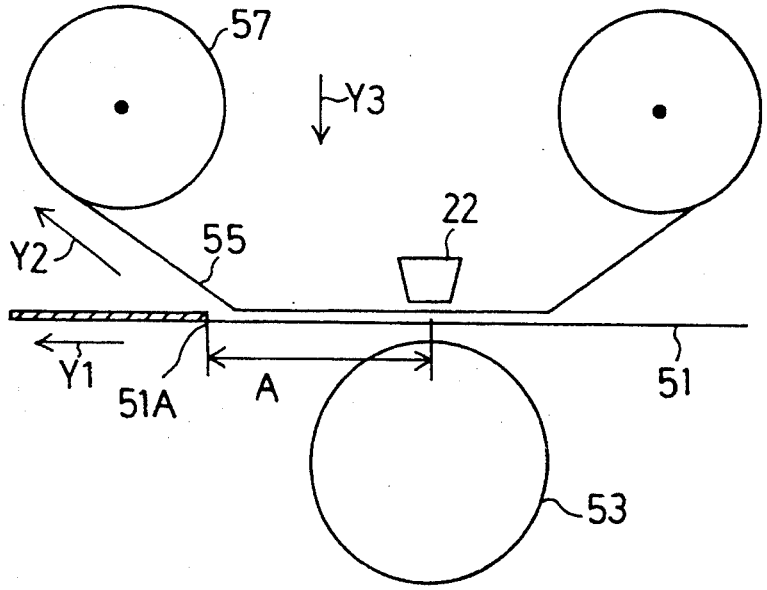
Fig.8(A) RELATED ART
FIGS. 8(A) and 8(B) are respectively schematic views for describing a white-line skip operation performed by the printer shown in FIG. 7.
Figure 8B:
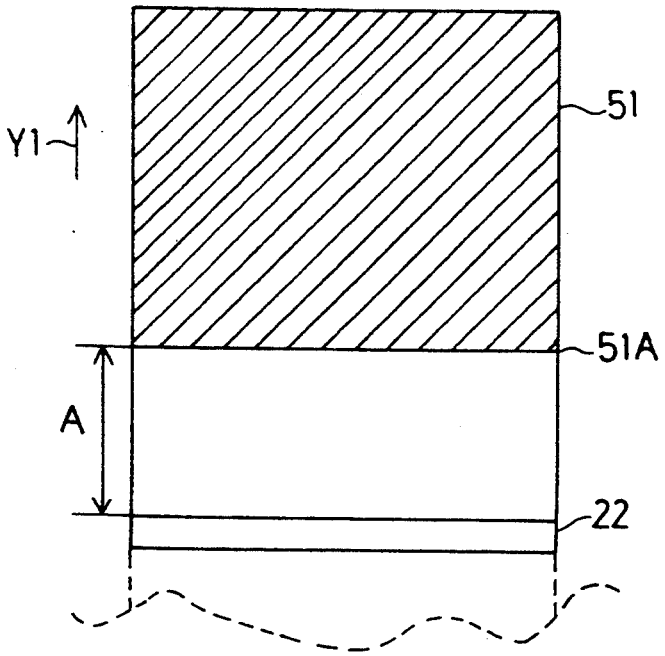
Fig.8(B) RELATED ART

A second embodiment of the invention will next be described with reference to FIGS. 6, 10 and 11.

The first embodiment referred to above shows the line printer type facsimile apparatus 10 as an illustrative example. However, the second embodiment will be described by a serial printer type printer 90 as an illustrative example. In the printer 90, the ribbon 55 is held in a cartridge 92, which is in turn fed in an axial direction of a platen 53 by a carriage 94. An image recording paper 51 is seated on the platen 53. The printer 90 is structured so that characters are serially printed for each line. However, when a blank area or portion exists during printing of one line, a white data skip process is started and the printing is stopped when the ribbon 55 has been fed by a distance A'. Further, the printer 90 is placed in a waiting state to resume printing of the current line. When the commencement of printing for the next line is determined without resuming the printing of the current line, the ribbon 55 is fed by a distance corresponding to a value of (X'−A') obtained by subtracting the already-fed distance A' from a distance X' for determination of the printing, i.e., by the sum of (X'−A')+A'=X', thereby determining the printing. As a result, consumption of the ribbon 55 can be reduced at the end of a line.

The operation will be described with reference to FIGS. 10 and 11.

Figure 10:
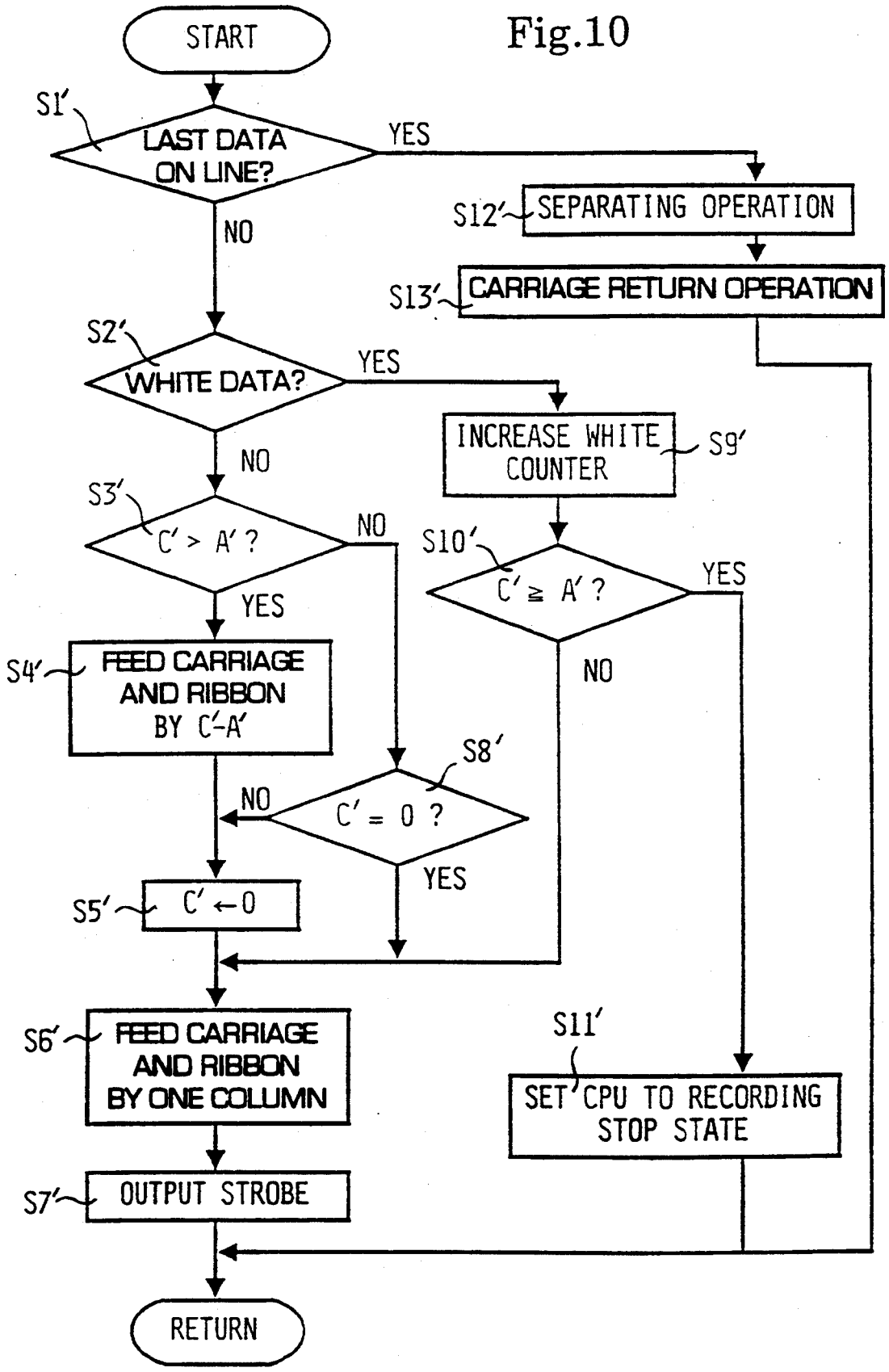
FIG. 10 is a flowchart of a printing operation of the printer apparatus of the second embodiment.
Figure 11:
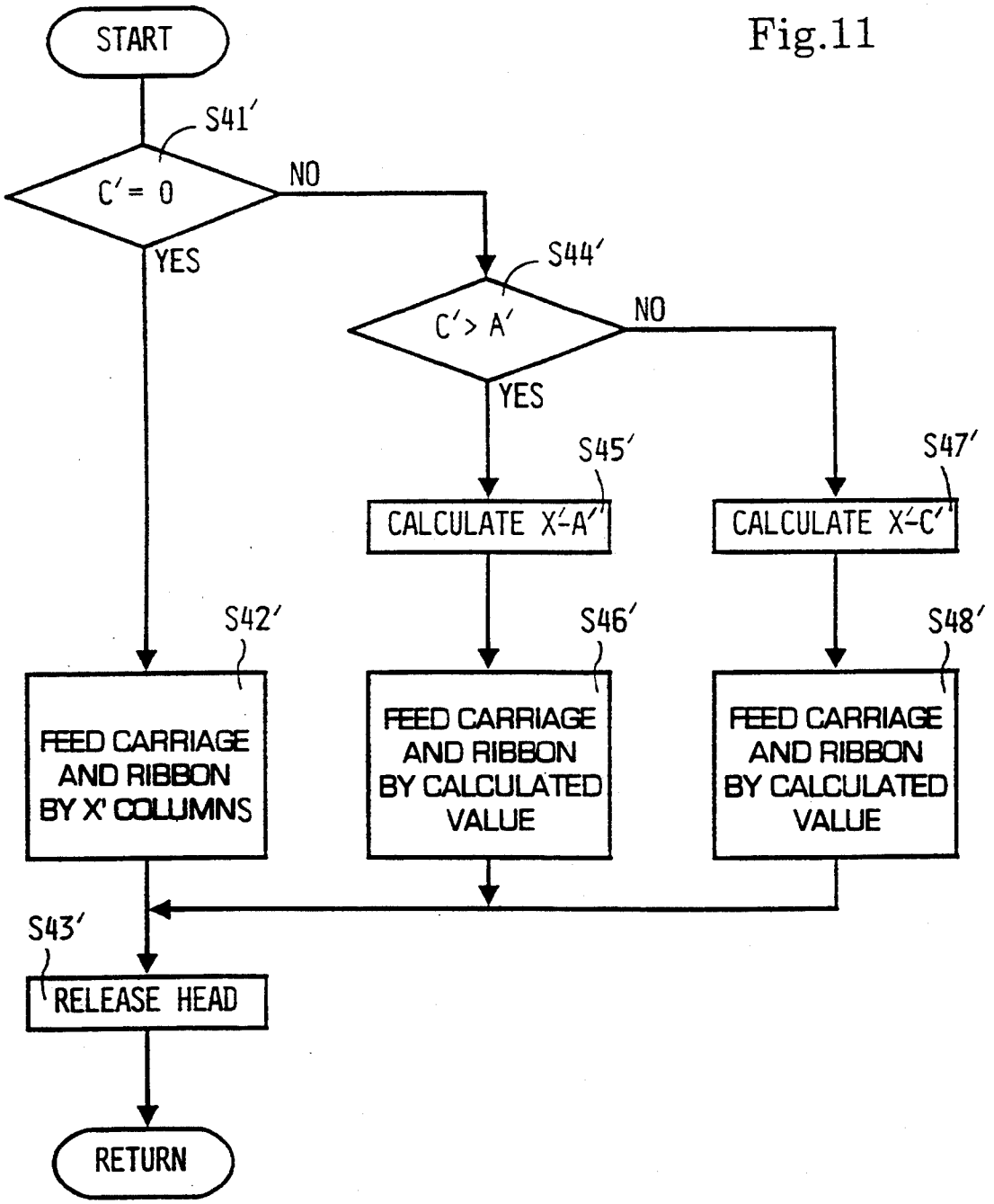
FIG. 11 is a flowchart of a line-return operation of the printer apparatus of the second embodiment.

The CPU 16 first determines, in Step S1', FIG. 10, whether a printing data corresponds to the last data on a line. When the answer is "NO" in Step S1', the routine proceeds to Step S2'. It is determined in Step S2' whether the corresponding data is white data, i.e., a blank portion or area for printing. If the data is not white data but a data to be printed, in Step S2', the answer is "NO". Hence, the routine proceeds to Step S3'. In Step S3', it is determined whether a value counted by the white data counter C' storing the number of blank areas or white print columns therein is greater than a stop value A' used in performing a white data skip. The stop value A' is a value previously determined. When the value of the white data counter C' is 0, it is lower than the stop value A'. Thus, the answer is "NO" in Step S3' and the routine proceeds to Step S8'. It is determined in Step S8' whether the value of the white data counter C is "0." Since the value of the white data counter C is "0" in Step S8', the answer is "YES", in Step S8', and, the routine shifts to Step S6'. In Step S6', the CPU 16 sends a command or instruction to the motor driver to drive a carriage feed motor (not shown), thereby feeding the carriage 94 with ribbon 55 by one column. Further, the CPU 16 gives an instruction to the motor driver to drive a ribbon feed motor (not shown) to rotate the ribbon take-up roller 98 in synchronization with the drive of the carriage 94, thereby feeding the ribbon 55 by one column. Next, the CPU 16 gives a print instruction to the strobe generating circuit in Step S7'. As a result, the strobe generating circuit outputs a strobe to the thermal head 96 to thereby effect printing on the corresponding column. A printing process corresponding to one column is completed based on the series of operations referred to above and the routine returns to Step S1' so that a printing process for the next column is started.

The printing process executed for each column of data is repeated until the end of the data in the line is reached. A process about a blank area or portion within a line will now be described. After completion of Step S1', the CPU 16 determines, in Step S2', whether the corresponding column of data is white data, i.e., a blank portion for printing. When that is the case, the answer is "YES" in Step S2', and the routine proceeds to Step S9'. In Step S9', a value C' of the white data counter, which counts the number of blank portions or columns, is increased by a value corresponding to one column. Next, the routine proceeds to Step S10', where it is determined whether the value C' of the white data counter is greater than or equal to the value A' for stopping a white data skip. For example, A' is set to a value of 35 columns although other values could be used. Since the value C' of the white data counter is smaller than the stop value A' when the process about the blank portion has just started (i.e., the answer is "NO" in Step S10'), the routine proceeds to the process in Step S6'. In Step S6', the CPU 16 feeds the carriage 94 and the ribbon 55 by one column. Next, the routine procedure proceeds to Step S7', where the CPU 16 gives a strobe output instruction to the strobe generating circuit to print a null or blank column. As a result, a blank area or portion is formed on the recording paper 51. The process for the one column is executed based on the just described series of operations and the routine returns to Step S1' so that a process for the following column is started.

When the above process is repeated to execute a printing process for the blank area or portion and the process for a column corresponding to the stop value A' for the white data skip is executed, the value C' of the white data counter is made equal to the stop value A'. Thus, the answer is "YES" in Step S10' and the routine proceeds to Step S11', where the CPU 16 is brought into a recording stop state. That is, the CPU 16 stops operating under the condition in which the carriage 94 and the ribbon 55 have been fed by the A' columns corresponding to the stop value. In this condition, the CPU 16 resumes the next printing operation or is placed in a waiting state until the last column on the line appears. At this time, the thermal head 96 is not released and the recording paper 51 is kept in a state of being in contact with the ribbon 55. Further, if data about the white data is continuously sent, the value C' of the white data counter is increased in Step S9' under the recording stop state.

When data other than the data about the white data is sent, the answer is "NO" again in Step S2' and the routine proceeds to Step S3'. In Step S3', the CPU 16 makes a decision as to whether the value C' of the white data counter is greater than the stop value A' at the time of execution of the white data skip. Since the value C' of the white line counter is greater than the stop value A' herein, the answer is "YES" in Step S3' and the routine proceeds to Step S4'. In Step S4', a further increase in the data from the stop value A' at which the feeding of the carriage 94 and the ribbon 55 has been stopped, i.e., a value obtained by subtracting the stop value A' from the value C' of the white data counter is determined. Further, the carriage 94 and the ribbon 55 are fed by a number of columns corresponding to the so-determined value. Next, the routine proceeds to Step S5', where the value C' of the white data counter is reset to 0. Thus, the blank area or portion is ended.

On the other hand, if the answer is negative in Step S3', that is when data other than white data is sent before executing the process about the A' columns corresponding to the stop value for the white data skip, the routine proceeds to Step S8', where a determination is made as to whether the value of the white data counter is "0." Thus, the blank area or portion is ended. Since, at this time, the value of the white data counter is not "0" in Step S8', the answer is "NO" in Step S8' and the routine shifts to Step S5', where the value C' of the white data counter is reset or initialized. Next, the routine procedure proceeds to Step S6'. In Step S6', the CPU 16 feeds each of the carriage 94 and the ribbon 55 by one column. In Step S7', the CPU 16 then gives a command or instruction to the strobe generating circuit to thereby carry out printing of the corresponding image data. The processing of one column is executed based on the series of operations described above and the routine returns to the process in Step S1' so that a process for the following column is started.

A description will now be made of a case where the last data column in the line has been detected during the process. When the last data column is first detected, the answer is "YES" in Step S1' and hence the routine procedure proceeds to Step S12'. At Step S12', a release or separating operation is started. The separating operation executed in Step S12' will be described with reference to the flowchart of FIG. 11 for describing the separating operation in detail. It is first determined in Step S41' whether the value C' of the white data counter is "0." When the value C' of the white data counter is found to be "0" (when the answer is "YES" in Step S41'), i.e., when neither the carriage 94 nor the ribbon 55 is fed from a position where an image data column to be printed is beneath the thermal head 96, the carriage 94 proceeds to Step S42', where each of the carriage 94 and the ribbon 55 is fed by a distance X' corresponding to a length required to determine printing. Next, the routine proceeds to Step S43' where the thermal head 96 is released. Thereafter, the routine proceeds to Step S13' on the flowchart shown in FIG. 10, where the process for carriage return is executed.

On the other hand, if it is determined in Step 41' that the value C' of the white data counter is not "0" (if the answer is "NO" in Step S41'), i.e., if it is determined that each of the carriage 94 and the ribbon 55 has been fed by several columns from the position of the last image data column printed, the routine proceeds to Step S44'. It is determined in Step S44' whether the value C', of the white data counter is greater than the stop value A', i.e., it is determined whether the carriage 94 and the ribbon 55 have been fed by the A' columns corresponding to the stop value as described above with reference to the flowchart of FIG. 10 and the CPU 16 has been brought into a stop state. If the value C' of the white data counter is greater than the stop value A', i.e., if it is determined that the CPU 16 has been stopped in a state in which the ribbon 55 has been fed by the A' columns corresponding to the stop value (if the answer is "YES" in Step S44'), the routine proceeds to Step S45'. The stop value A' is subtracted from the value X' for determining the printing in Step S45'. The routine then proceeds to Step S46', where each of the carriage 94 and the ribbon 55 is further fed by a value of X'−A' from a state in which the carriage 94 and the ribbon 55 have been fed by the A' columns. Thus, both the carriage 94 and the ribbon 55 are fed by the sum of the A' columns by which both the carriage 94 and the ribbon 55 have been previously fed and the X'−A' columns, i.e., for a total of X' columns Further, the routine proceeds to Step S43', where the thermal head 96 at the end of the line is released. Thereafter, the routine is returned to Step S13' on the flowchart shown in FIG. 10, where the process for carriage return is executed.

If it is determined in Step S44' that the value C' of the white data counter is smaller than the stop value A', i.e., if both of the carriage 94 and the ribbon 55 are fed by C' columns into a blank area or portion, but the A' columns, at which the feeding of the ribbon 55 is stopped, have not been fed (i.e., if the answer is "NO" in Step S44'), then the routine proceeds to Step S47'. In Step 47', the value C' of the white data counter is subtracted from the value X' for the determination of printing. Next, the routine proceeds to Step S48', where both the carriage 94 and the ribbon 55 have been fed by the C' columns and are further fed by a calculated X'−C' columns. Thus, both the carriage 94 and the ribbon 55 are fed by the sum of the C' columns, by which each of them has already been fed, and the X'−C' columns, i.e., for a total of X' columns, to thereby determine the printing. Further, the routine proceeds to Step S43', where the thermal head 96 is released. Thereafter, the routine returns to Step S13' so that the carriage return is complete.

In both embodiments, the likelihood of smudging the recording medium when the printhead is returned to the print position is reduced as the number of times the printhead releases from the ink ribbon, or print position, is reduced.

A further benefit is that when the printhead is released from the ink ribbon and returned to contact therewith, it may be misaligned with the previously printed material thus resulting in a poor appearance to the printed page. The invention, since it minimizes the separations, or releases, of the printhead, minimizes the likelihood of such misalignments.

Having now fully described the invention, it will be apparent to those skilled in the art that many changes and modifications can be made without departing from the spirit or scope of the invention as set forth herein.

What is claimed is:

1. A printer, comprising:

ribbon feeding means for feeding a ribbon;

recording paper feeding means for feeding recording paper;

printing means for maintaining the ribbon and the recording paper in contact during printing and for a predetermined distance after printing ceases to fix the printing;

blank space detecting means for detecting and creating a count of sequential blank spaces;

wait determining means for determining when the count is greater than a predetermined value and stopping the ribbon feeding means and the recording paper feeding means at that point;

action detecting means for detecting a one of a print space and an end of print portion;

calculating means for calculating a further move distance after the wait determining means stops the ribbon feeding means and the recording paper feeding means at the stopping point, the further move distance being the distance between the predetermined distance and the predetermined value when the end of print portion is detected and the distance between the count and the predetermined distance when the print space is detected after the sequential blank spaces.

2. The printer according to claim 1, wherein said recording paper feeding means feeds the recording paper in synchronism with the feeding of the ribbon by said ribbon feeding means for every one line.

3. The printer according to claim 1, further comprising a printhead carriage, wherein said recording paper feeding means feeds the printhead carriage in synchronism with the feeding of the ribbon by said ribbon feeding means for every print column.

4. The printer according to claim 1, wherein said recording paper feeding means feeds the recording paper in an orthogonal direction to the feeding direction of the ribbon fed by said ribbon feeding means.

5. A method for feeding an ink ribbon in a printer, comprising the steps of:

identifying whether data is white data;

increasing a count of white data when the data is white data;

determining whether the count is greater than a predetermined value;

advancing the ink ribbon for the white data each time the count is increased until the count equals the predetermined value;

comparing the count to the predetermined value;

selecting the lesser of the count and the predetermined value when a data end has been detected;

reading a necessary data advance distance necessary to ensure satisfactory printing;

detecting the data end; and calculating an ink ribbon advance amount upon detecting the data end to advance the ink ribbon a distance sufficient to obtain satisfactory printing, wherein the ink ribbon advance amount is equal to the sufficient distance for satisfactory printing minus the smaller of the count and the predetermined value previously selected.

6. The method as claimed in claim 5, wherein said data end comprise a page end.

7. The method as claimed in claim 5, wherein said data end comprises a line end.

8. The method as claimed in claim 5, further comprising the steps of:

separating a recording head and ink ribbon from the recording medium when the recording medium has advanced the sufficient distance; and relatively advancing the recording medium with respect to the recording head.

9. The method in claim 8, wherein said step of relatively advancing the recording medium comprises ejection of a printed page.

10. The method as claimed in claim 8, wherein said step of relatively advancing the recording medium comprises returning the recording head to a beginning of a next line to be printed.

11. The method as claimed in claim 5, wherein the white data comprises a dot line of blank or null data.

12. The method as claimed in claim 5, wherein the white data comprises a dot column of blank or null data.

13. The method as claimed in claim 5, wherein a recording medium is advanced relative to a recording head in synchronization with the ink ribbon advance.

14. An ink ribbon feeding apparatus in a printer, comprising:

means for identifying whether a data is white data;

means for increasing a count of white data when the data is white data;

means for determining whether the count is greater than a predetermined value;

means for advancing the ink ribbon for the white data each time the count is increased until the count equals the predetermined value;

means for comparing the count to the predetermined value;

means for selecting the lesser of the count and the predetermined value when a data end has been detected;

means for reading a data advance distance necessary to ensure satisfactory printing;

means for detecting the data end; and means for calculating an ink ribbon advance amount upon detecting the data end to advance the ink ribbon a distance sufficient to obtain satisfactory printing, wherein the ink ribbon advance amount is equal to the sufficient distance for satisfactory printing minus the greater of the count and the predetermined value previously selected.

15. The apparatus as claimed in claim 14, wherein said data end comprise a page end.

16. The apparatus as claimed in claim 14, wherein said data end comprises a line end.

17. The apparatus as claimed in claim 14, further comprising:

means for separating a recording head and ink ribbon from the recording medium when the recording medium has advanced the sufficient distance; and means for relatively advancing the recording medium with respect to the recording head.

18. The apparatus in claim 17, wherein said means for relatively advancing the recording medium comprises means for ejection of a printed page.

19. The apparatus as claimed in claim 17, wherein said means for relatively advancing the recording medium comprises means for returning the recording head to a beginning of a next line to be printed.

20. The apparatus as claimed in claim 14, wherein the white data comprises a dot column of blank or null data.

21. The apparatus as claimed in claim 14, wherein a recording medium is advanced relative to a recording head in synchronization with the ink ribbon advance.

22. The apparatus as claimed in claim 14, wherein the white data comprises a dot line of blank or null data.

* * * * *